US009916801B2

(12) United States Patent
Lin et al.

(10) Patent No.: US 9,916,801 B2
(45) Date of Patent: Mar. 13, 2018

(54) PIXEL STRUCTURE AND DISPLAY DEVICE FOR DOT INVERSION, AND DRIVING METHOD OF DISPLAY DEVICE

(71) Applicants: Shanghai AVIC OPTO Electronics Co., Ltd., Shanghai (CN); Tianma Micro-Electronics Co., Ltd., Shenzhen (CN)

(72) Inventors: Yao Lin, Shanghai (CN); Zhaokeng Cao, Shanghai (CN); Dandan Qin, Shanghai (CN); Shoufu Jian, Shanghai (CN); Tinghai Wang, Shanghai (CN); Yinghua Mo, Shanghai (CN)

(73) Assignees: SHANGHAI AVIC OPTO ELECTRONICS CO., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 58 days.

(21) Appl. No.: 14/743,941

(22) Filed: Jun. 18, 2015

(65) Prior Publication Data

US 2016/0104447 A1 Apr. 14, 2016

(30) Foreign Application Priority Data

Oct. 10, 2014 (CN) ..... 2014 1 0531219

(51) Int. Cl.
*G09G 3/36* (2006.01)

(52) U.S. Cl.
CPC ..... *G09G 3/3648* (2013.01); *G09G 3/3614* (2013.01)

(58) Field of Classification Search
CPC ..... G09G 3/3648; G09G 3/3614
See application file for complete search history.

(56) References Cited

U.S. PATENT DOCUMENTS

2007/0097072 A1* 5/2007 Kim ..... G09G 3/3614 345/103
2007/0132684 A1* 6/2007 Baek ..... G09G 3/3614 345/87
2013/0113686 A1* 5/2013 Chen ..... G09G 3/3648 345/55
2015/0179121 A1* 6/2015 Lee ..... G02F 1/136227 345/103

FOREIGN PATENT DOCUMENTS

CN 104090440 A 10/2014
JP 2014041366 A 3/2014

* cited by examiner

*Primary Examiner* — Lisa Landis
(74) *Attorney, Agent, or Firm* — Faegre Baker Daniels LLP

(57) ABSTRACT

A pixel structure, array substrate, display panel, display device, and driving method of the display device are provided. The pixel structure includes a plurality of data lines and a plurality of scan lines; a plurality of pixel units formed by intersecting the data lines with the scan lines. Each of the pixel units corresponds to one of the data lines and one of the scan lines; and the pixel unit includes a pixel electrode and a thin film transistor therein. In one of two adjacent columns of pixel units, a pixel electrode of each pixel unit is electrically connected with a thin film transistor of the pixel unit; and in the other one of the two adjacent columns of pixel units, a pixel electrode of each pixel unit in a row is electrically connected with a thin film transistor of a pixel unit in an adjacent row.

10 Claims, 13 Drawing Sheets

| | D1 | D2 | D3 | D4 | D5 | D6 | D7 |
|---|---|---|---|---|---|---|---|
| S1 | + | − | + | − | + | − | + |
| S2 | | + | | + | | + | |
| S3 | | | | | | | |
| S4 | | | | | | | |
| S5 | | | | | | | |
| S6 | | | | | | | |
| S7 | | | | | | | |
| | + | + | + | + | + | + | + |

FIGURE 9B

| | D1 | D2 | D3 | D4 | D5 | D6 | D7 |
|---|---|---|---|---|---|---|---|
| S1 | + | − | + | − | + | − | + |
| S2 | − | + | − | + | − | + | − |
| S3 | + | − | + | − | + | − | + |
| S4 | − | + | − | + | − | + | − |
| S5 | + | − | + | − | + | − | + |
| S6 | − | + | − | + | − | + | − |
| S7 | | | | | | | |

FIGURE 9C

| | D1 | D2 | D3 | D4 | D5 | D6 | D7 |
|---|---|---|---|---|---|---|---|
| S1 | + | – | + | – | + | – | + |
| S2 | – | + | – | + | – | + | – |
| S3 | + | – | + | – | + | – | + |
| S4 | – | + | – | + | – | + | – |
| S5 | + | – | + | – | + | – | + |
| S6 | – | + | – | + | – | + | – |
| S7 | | | | | | | |

A first frame of image

FIGURE 10A

| | D1 | D2 | D3 | D4 | D5 | D6 | D7 |
|---|---|---|---|---|---|---|---|
| S1 | – | + | – | + | – | + | – |
| S2 | + | – | + | – | + | – | + |
| S3 | – | + | – | + | – | + | – |
| S4 | + | – | + | – | + | – | + |
| S5 | – | + | – | + | – | + | – |
| S6 | + | – | + | – | + | – | + |
| S7 | | | | | | | |

A second frame of image

FIGURE 10B

| | D1 | D2 | D3 | D4 | D5 | D6 | D7 |
|---|---|---|---|---|---|---|---|
| S1 | + | – | + | – | + | – | + |
| S2 | – | + | – | + | – | + | – |
| S3 | + | – | + | – | + | – | + |
| S4 | – | + | – | + | – | + | – |
| S5 | + | – | + | – | + | – | + |
| S6 | – | + | – | + | – | + | – |
| S7 | | | | | | | |

A first frame of image

FIGURE 11A

| | D1 | D2 | D3 | D4 | D5 | D6 | D7 |
|---|---|---|---|---|---|---|---|
| S1 | + | – | + | – | + | – | + |
| S2 | – | + | – | + | – | + | – |
| S3 | + | – | + | – | + | – | + |
| S4 | – | + | – | + | – | + | – |
| S5 | + | – | + | – | + | – | + |
| S6 | – | + | – | + | – | + | – |
| S7 | | | | | | | |

A second frame of image

FIGURE 11B

| | D1 | D2 | D3 | D4 | D5 | D6 | D7 |
|---|---|---|---|---|---|---|---|
| S1 | | | | | | | |
| S2 | – | + | – | + | – | + | – |
| S3 | + | – | + | – | + | – | + |
| S4 | – | + | – | + | – | + | – |
| S5 | + | – | + | – | + | – | + |
| S6 | – | + | – | + | – | + | – |
| S7 | + | – | + | – | + | – | + |

A third frame of image

FIGURE 11C

| | D1 | D2 | D3 | D4 | D5 | D6 | D7 |
|---|---|---|---|---|---|---|---|
| S1 | | | | | | | |
| S2 | – | + | – | + | – | + | – |
| S3 | + | – | + | – | + | – | + |
| S4 | – | + | – | + | – | + | – |
| S5 | + | – | + | – | + | – | + |
| S6 | – | + | – | + | – | + | – |
| S7 | + | – | + | – | + | – | + |

A fourth frame of image

FIGURE 11D

PIXEL STRUCTURE AND DISPLAY DEVICE FOR DOT INVERSION, AND DRIVING METHOD OF DISPLAY DEVICE

CROSS-REFERENCE TO RELATED APPLICATION

This application claims priority to Chinese Application No. 201410531219.4, filed Oct. 10, 2014, which is herein incorporated by reference in its entirety.

TECHNICAL FIELD

The present application relates to a field of display technologies, in particular, to a pixel structure, an array substrate, a display panel, a display device, and a driving method of the display device.

BACKGROUND

With the development of display technologies, Liquid Crystal Display (LCD) devices have been widely used, and the display effect of the LCD devices is improved continuously.

Generally, in the LCD device, the polarity of a voltage difference applied to liquid crystal molecules must be inverted periodically, to prevent the liquid crystal material from being destroyed permanently due to the polarization of the liquid crystal material, and to further avoid the residual image effect. The common polarity inversion methods include a frame inversion method, a dot inversion method, a column inversion method, a row inversion method, a double-column inversion method, and a double-dot inversion method. Among the above inversion methods, the frame inversion method is advantageous for the minimum power consumption but is susceptible to a flicker phenomenon; the dot inversion method is disadvantageous for the maximum power consumption but has the best display effect; and the column inversion method, the row inversion method, the double-column inversion method, and the double-dot inversion method cause power consumption between the power consumption of the dot inversion method and the power consumption of the frame inversion method.

Based on the characteristics of the above inversion methods, column inversion or row inversion is generally used to implement the dot inversion method in the related art, in order to reduce the power consumption caused by the polarity inversion. FIG. 1 is a schematic structure diagram of a pixel structure in the related art. As shown in FIG. 1, the pixel structure, in which the dot inversion is implemented by the column inversion, includes a plurality of data lines 11, a plurality of scan lines 12, a plurality of pixel units 13 formed by intersecting the plurality of data lines 11 with the plurality of scan lines 12, and a thin film transistor 14 and a pixel electrode 15 located in each of the pixel units 13. A gate electrode of each thin film transistor 14 is electrically connected to the scan line 12 below the thin film transistor 14, and a drain electrode of each thin film transistor 14 is electrically connected to the pixel electrode 15 of the pixel unit 13 including the thin film transistor 14. For any two adjacent rows of the pixel units 13, the source electrodes of the thin film transistors 14 from one of the two adjacent rows of the pixel units 13 are electrically connected to the data lines 11 on the left thereof, and the source electrodes of the thin film transistors 14 from the other one of the two adjacent rows of the pixel units 13 are electrically connected to the data lines 11 on the right thereof, that is, the thin film transistors 14 from the odd rows of pixel units 13 and the thin film transistors 14 from the even rows of pixel units 13 are connected to the data lines 11 on different sides, respectively.

However, for the above described pixel structure, if the source electrode and drain electrode of a thin film transistor 14 are not positioned relative to the gate electrode of the thin film transistor 14 during manufacturing the thin film transistor 14, for example, the source electrode and drain electrode deflect to the left or right relative to the desired positions, then an overlapped area between the drain electrode and the gate electrode of a thin film transistor 14 from the odd row is unequal to an overlapped area between the drain electrode and the gate electrode of a thin film transistor 14 from the even row, so that the capacitance formed by the drain electrode and the gate electrode of the thin film transistor 14 from the odd row is unequal to the capacitance formed by the drain electrode and the gate electrode of the thin film transistor 14 from the even row, as a result, when scan signals applied by the scan lines 11 are pulled down, voltages of the pixel electrodes 15 from the odd row are pulled down to a different degree as compared with voltages of the pixel electrodes 15 from the even row, and accordingly, the common electrode compensating voltage required for the pixel electrode 15 from the odd row is different from that required for the pixel electrode 15 from the even row. Because the common electrode is planar, i.e., the common electrode located above different pixel electrodes 15 is applied with the same common voltage, the common electrode cannot completely compensate for the voltages of the pixel electrodes 15 from the odd rows or from the even rows, thereby generating transverse striations and the flicker in the pixel structure.

SUMMARY

The present disclosure provides a pixel structure, an array substrate, a display panel, a display device, and a driving method of the display device, so that in the pixel structure where the dot inversion is implemented by the column inversion in the related art, the transverse striations and the flicker in the pixel structure generated due to the imprecise position of the thin film transistor in the pixel structure can be eliminated.

Embodiments of the disclosure provide a pixel structure, including:

a plurality of data lines and a plurality of scan lines;

a plurality of pixel units formed by intersecting the plurality of data lines with the plurality of scan lines, wherein each of the pixel units corresponds to one of the plurality of data lines and one of the plurality of scan lines; and a pixel unit comprises a pixel electrode and a thin film transistor therein; and wherein in one of two adjacent columns of pixel units, a pixel electrode of each pixel unit is electrically connected with a thin film transistor of the pixel unit; and in the other one of the two adjacent columns of pixel units, a pixel electrode of each pixel unit in a row is electrically connected with a thin film transistor of a pixel unit in an adjacent row.

Embodiments of the disclosure provide a display panel, including the above array substrate.

Embodiments of the disclosure provide a display device, including the above display panel.

Embodiments of the disclosure provide a driving method of a display device, which is performed by the above display device, including:

in displaying a frame of image, turning on, by a first row of scan line, the pixel units controlled by the first row of scan line, and applying a first data signal to the turned-on pixel units by the data lines;

turning off the pixel units controlled by the first row of scan line, and then turning on, by a second row of scan line, the pixel units controlled by the second row of scan line, and applying a second data signal to the turned-on pixel units by the data lines, wherein, polarity of the second data signal is inverse to polarity of the first data signal; and sequentially turning on, by remaining rows of scan lines, the pixel units controlled by the remaining rows of scan lines, and alternately applying the first data signal and the second data signal to the turned-on pixel units line by line by the data lines so as to implement displaying of the frame of image; and wherein, a pixel unit comprises a pixel electrode and a thin film transistor, in one of two adjacent columns of pixel units, a pixel electrode of each pixel unit is electrically connected with a thin film transistor of the pixel unit; and in the other one of the two adjacent columns of pixel units, a pixel electrode of each pixel unit in a row is electrically connected with a thin film transistor of a pixel unit in an adjacent row.

With the pixel structure, array substrate, display panel, display device, and driving method of the display device, according to embodiments of the disclosure, in one of two adjacent columns of pixel units, a pixel electrode of each pixel unit is electrically connected with a thin film transistor of the pixel unit; and in the other one of the two adjacent columns of pixel units, a pixel electrode of each pixel unit in a row is electrically connected with a thin film transistor of a pixel unit in an adjacent row, so that for a certain row of pixel units, the pixel units controlled by two scan lines adjacent to the certain row of pixel units are alternately arranged, thereby implementing dot inversion by row inversion while ensuring a lower power consumption in polarity inversion. Additionally, to the above pixel structure, even if the source electrode and drain electrode of the thin film transistor are not precisely positioned relative to the gate electrode during manufacturing the thin film transistor, when the scanning signals applied by the scan lines are pulled down, the voltages of the pixel electrodes from the odd rows of pixel units are pulled down to the same degree as the voltages of the pixel electrodes from the even rows of pixel units, and accordingly, the common electrode compensating voltage required for the pixel electrode from the odd rows is equal to that required for the pixel electrode from the even rows, that is, the voltages of the pixel electrodes from both the odd rows and the even rows can be completely compensated by a common electrode, therefore, transverse striations and the flicker generated due to incomplete compensation by the common electrode for the voltages of the pixel electrodes from the odd rows and from the even rows can be avoided, and thus improving the display effect of the pixel structure.

While multiple embodiments are disclosed, still other embodiments of the disclosure will become apparent to those skilled in the art from the following detailed description, which shows and describes illustrative embodiments of the disclosure. Accordingly, the drawings and detailed description are to be regarded as illustrative in nature and not restrictive.

BRIEF DESCRIPTION OF THE DRAWINGS

Other features, objects and advantages of the disclosure will become apparent from the following detailed description made to nonrestrictive embodiments with reference to the accompanying drawings below, in which:

FIGS. 9A to 9C are schematic diagrams showing polarity inversion corresponding to steps for achieving the dot inversion by the row inversion, according to embodiments of the disclosure;

FIGS. 10A to 10B are schematic diagrams showing the polarity inversion in a display device, according to embodiments of the disclosure; and FIGS. 11A to 11D are schematic diagrams showing the polarity inversion in another display device, according to embodiments of the disclosure.

Figure 1:
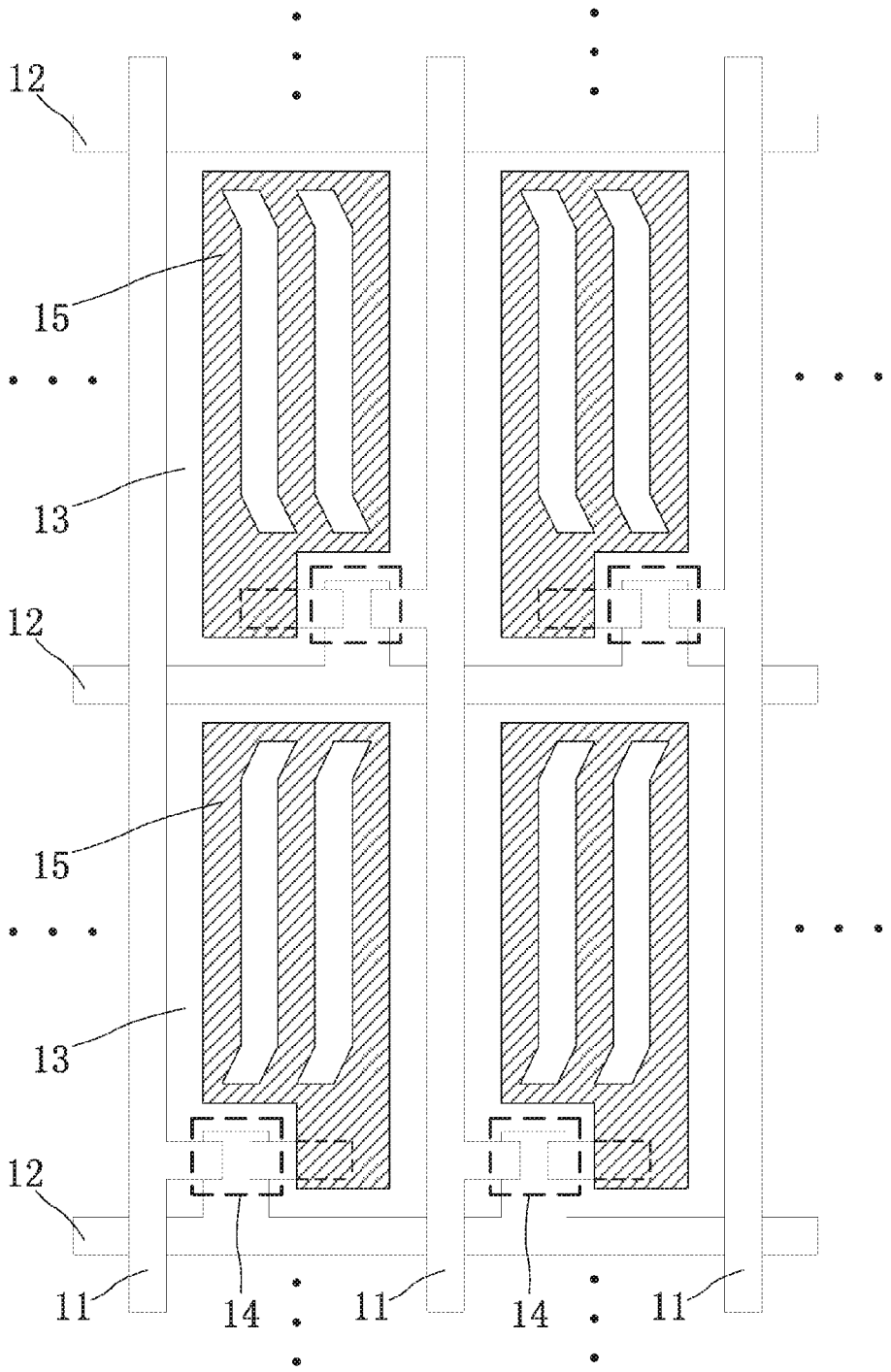
FIG. 1 is a schematic diagram of the structure of a pixel structure in the related art.

While the disclosure is amenable to various modifications and alternative forms, embodiments have been shown by way of example in the drawings and are described in detail below. The intention, however, is not to limit the disclosure to the particular embodiments described. On the contrary, the disclosure is intended to cover all modifications, equivalents, and alternatives falling within the scope of the disclosure as defined by the appended claims.

DETAILED DESCRIPTION

The disclosure will be further illustrated in detail below in conjunction with the accompanying drawings and embodiments. It may be understood that embodiments described herein are for explaining the disclosure rather than limiting the disclosure. Additionally, it is noted that partial contents associated with the disclosure rather than all contents are illustrated in the accompanying drawings for ease of description.

Figure 2A:
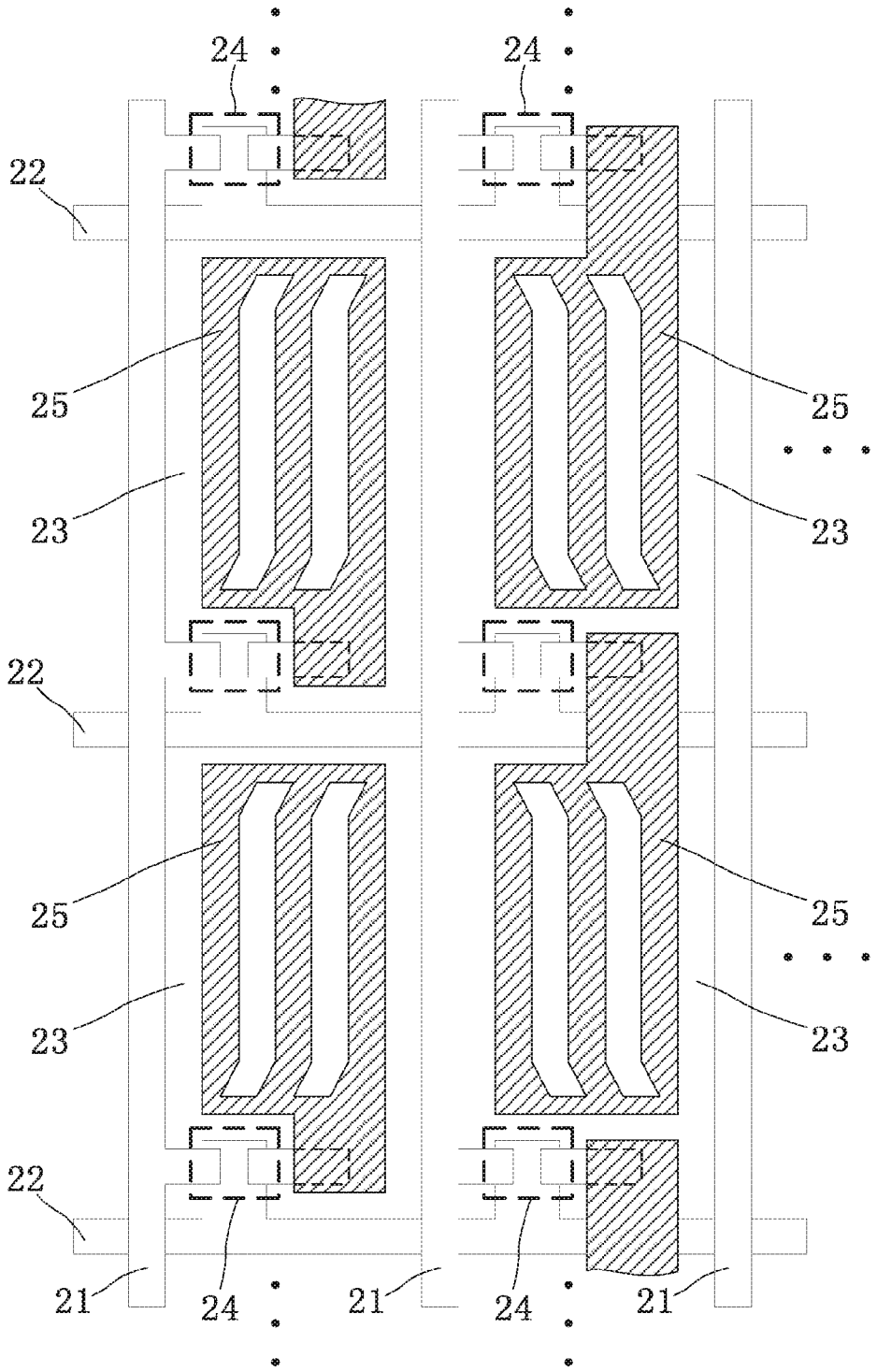
FIG. 2A is a schematic diagram of the structure of a pixel structure, according to embodiments of the disclosure.

Embodiments of the disclosure provide a pixel structure. FIG. 2A is a schematic diagram of the structure of a pixel structure, according to embodiments of the disclosure. As shown in FIG. 2A, the pixel structure includes a plurality of data lines 21, a plurality of scan lines 22, and a plurality of pixel units 23 formed by intersecting the plurality of data lines 21 with the plurality of scan lines 22, where each of the pixel units 23 corresponds to one of the plurality of data lines 21 and one of the plurality of scan lines 21; and each of the pixel units 23 includes a pixel electrode 25 and a thin film transistor 24 therein. In one of two adjacent columns (an odd column shown in FIG. 2A) of pixel units, a pixel electrode 25 of each pixel unit 23 is electrically connected with a thin film transistor 24 of the pixel unit; and in the other one of the two adjacent columns (an even column shown in FIG. 2A) of pixel units, a pixel electrode 25 of each pixel unit 23 in a row is electrically connected with a thin film transistor 24 of a pixel unit in an adjacent row.

It should be noted that the display of the pixel unit is implemented by the pixel electrode of the pixel unit and the thin film transistor electrically connected with and configured for controlling the pixel electrode. The thin film transistor controls the pixel electrode, and hence controls the pixel unit including the pixel electrode. The scan line electrically connected with the gate electrode of the thin film transistor can turn on or turn off the thin film transistor. The data line electrically connected with the source electrode of the thin film transistor can provide a data signal for the pixel electrode electrically connected with the thin film transistor when the thin film transistor is turned on. Based on this, each of such pixel units 23 corresponds to one of the data lines 21 and one of the scan lines 22. Specifically, the data line 21 corresponding to the pixel unit 23 is the one electrically connected with the thin film transistor 24 for controlling the pixel unit 23; and the scan line 22 corresponding to the pixel unit 23 is the one electrically connected with the thin film transistor 24 for controlling the pixel unit 23.

Figure 2B:
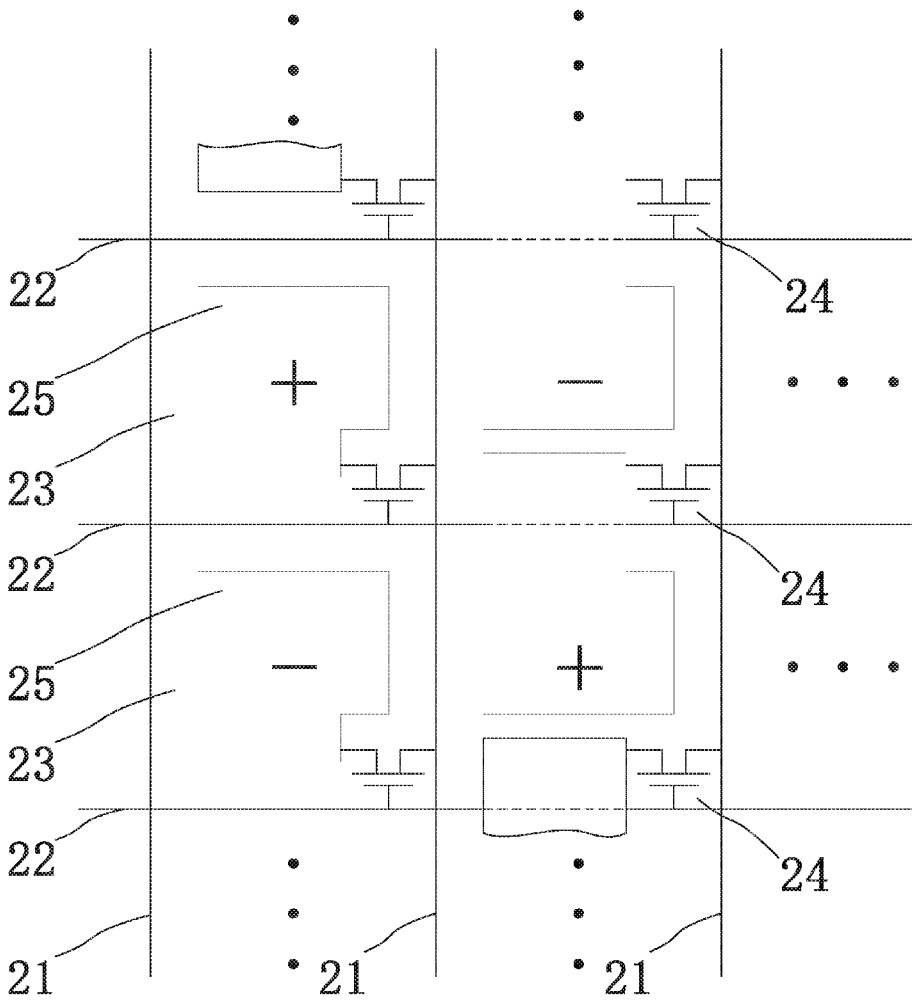
FIG. 2B is a schematic diagram of the structure of the pixel structure in FIG. 2A, where dot inversion is implemented by row inversion, according to embodiments of the disclosure.

If the polarity inversion in the above pixel structure is implemented by row inversion, as shown in FIG. 2B, polarities of the data signals applied to the pixel units 23 controlled by any two adjacent scan lines 22 (corresponding to two adjacent rows of pixel units) are inverse to each other. The polarity of the data signal is determined by a voltage difference between the voltage of the data signal and the common voltage. If the voltage difference is greater than 0, the polarity of the data signal is positive and indicated by "+" in FIG. 2B; and if the voltage difference is less than 0, the polarity of the data signal is negative and indicated by "−" in FIG. 2B. In FIG. 2B, in one of two adjacent columns of pixel units 23 (for example, an odd column of pixel units shown in FIG. 2B), the pixel electrode 25 of each pixel unit 23 is electrically connected with the thin film transistor 24 of the pixel unit 23, and in the other one of the two adjacent columns of pixel units (for example, an even column of pixel units shown in FIG. 2B), the pixel electrode 25 of each pixel unit 23 in a row is electrically connected with the thin film transistor 24 of a pixel unit 23 in an adjacent row (for example, a preceding adjacent row shown in FIG. 2B). Therefore, in a certain row of pixel units 23, the pixel units controlled by the scan line above the row of the pixel units are arranged alternately in this row with the pixel units controlled by the scan line below the row of the pixel units, that is, in a certain row of pixel units, the polarities of the data signals applied to two adjacent pixel units are inverse to each other, and in two adjacent rows of pixel units, the polarities of the data signals applied to two pixel units in the same column are inverse to each other. As described above, the dot inversion is implemented by the row inversion in the pixel structure shown in FIG. 2A, thus reducing the power consumption caused by the polarity inversion as in the related art. It should be noted that such polarity inversion may be implemented in a polarity inversion driving period including two frames of images, or alternatively in a polarity inversion driving period including four frames of images or a larger even number of frames of images. Preferably, the polarity inversion driving period includes two frames of images.

Additionally, since all the thin film transistors 24 are electrically connected with the data lines located in the same side of the thin film transistors 24 (for example, the left side shown in FIG. 2A), even if the source electrode and drain electrode of the thin film transistor 24 are not precisely positioned relative to the gate electrode during manufacturing the thin film transistor 24, the overlapped area between the drain electrode and the gate electrode of the thin film transistor 24 from the odd rows of thin film transistors 24 is equal to the overlapped area between the drain electrode and the gate electrode of the thin film transistor 24 from the even rows of thin film transistors 24, so that the capacitance formed by the drain electrode and the gate electrode of the thin film transistors 24 from the odd rows of thin film transistors 24 is equal to the capacitance formed by the drain electrode and the gate electrode of the thin film transistor 24 from the even rows of the thin film transistors 24. In such cases, when the scanning signals applied by the scan lines 22 are pulled down, the voltages of the pixel electrodes 25 from the odd rows of pixel units are pulled down to the same degree as the voltages of the pixel electrodes 25 from the even rows of pixel units, and accordingly, the common electrode compensating voltage required for the pixel electrode 25 from the odd rows is equal to that required for the pixel electrode 25 from the even rows. Since the voltages of the pixel electrodes 25 from both the odd rows and the even rows can be completely compensated by a common electrode when compared with the related art, transverse striations and the flicker generated due to incomplete compensation by the common electrode for the voltages of the pixel electrodes 25 from the odd rows and from the even rows can be avoided, and thus improving the display effect of the pixel structure.

The pixel structure as shown in FIG. 2A is an example where in each of odd columns of pixel units 23, a pixel electrode 25 of each pixel unit 23 is electrically connected with a thin film transistor 24 of the pixel unit 23; and in each of even columns of pixel units 23, a pixel electrode 25 of each pixel unit 23 in a row is electrically connected with a thin film transistor 24 of a pixel unit 23 in an adjacent preceding row. In another example, as shown in FIG. 2C, the pixel structure may be designed in such a way that in each of even columns of pixel units 23, a pixel electrode 25 of each pixel unit 23 is electrically connected with a thin film transistor 24 of the pixel unit 23; and in each of odd columns of pixel units 23, a pixel electrode 25 of each pixel unit 23 in a row is electrically connected with a thin film transistor 24 of a pixel unit 23 in an adjacent row.

In embodiments of the disclosure, a source electrode of a thin film transistor 24 is electrically connected to the data line 21 corresponding to the pixel unit 23 including the pixel electrode 25 electrically connected with the thin film transistor 24; and a gate electrode of the thin film transistor 24 is electrically connected to the scan line 22 corresponding to the pixel unit 23 including the pixel electrode 25 electrically connected with the thin film transistor 24. As shown in FIGS. 2A and 2C, the gate electrode of each of the thin film transistors 24 is electrically connected to the scan line 22 below the pixel unit 23 including the thin film transistor 24. The source electrode of each of the thin film transistors 24 is electrically connected to the data line 21 on the left side of the pixel unit 23 including the thin film transistor 24. In FIG. 2A, in each of odd columns of pixel units, the thin film transistor 24 of each pixel unit 23 is electrically connected to the pixel electrode 25 of the pixel unit 23; and in each of the even columns of pixel units, the thin film transistors 24 of each pixel unit 23 is electrically connected to the pixel electrode 25 of a pixel unit 23 in an next adjacent row. However, in FIG. 2C, in each of odd columns of pixel units, the thin film transistor 24 of each pixel unit 23 is electrically connected to the pixel electrode 25 of a pixel unit 23 in a next adjacent row; and in each of the even columns of pixel units, the thin film transistors 24 of each pixel unit 23 is electrically connected to the pixel electrode 25 of the pixel unit 23.

Figure 2C:
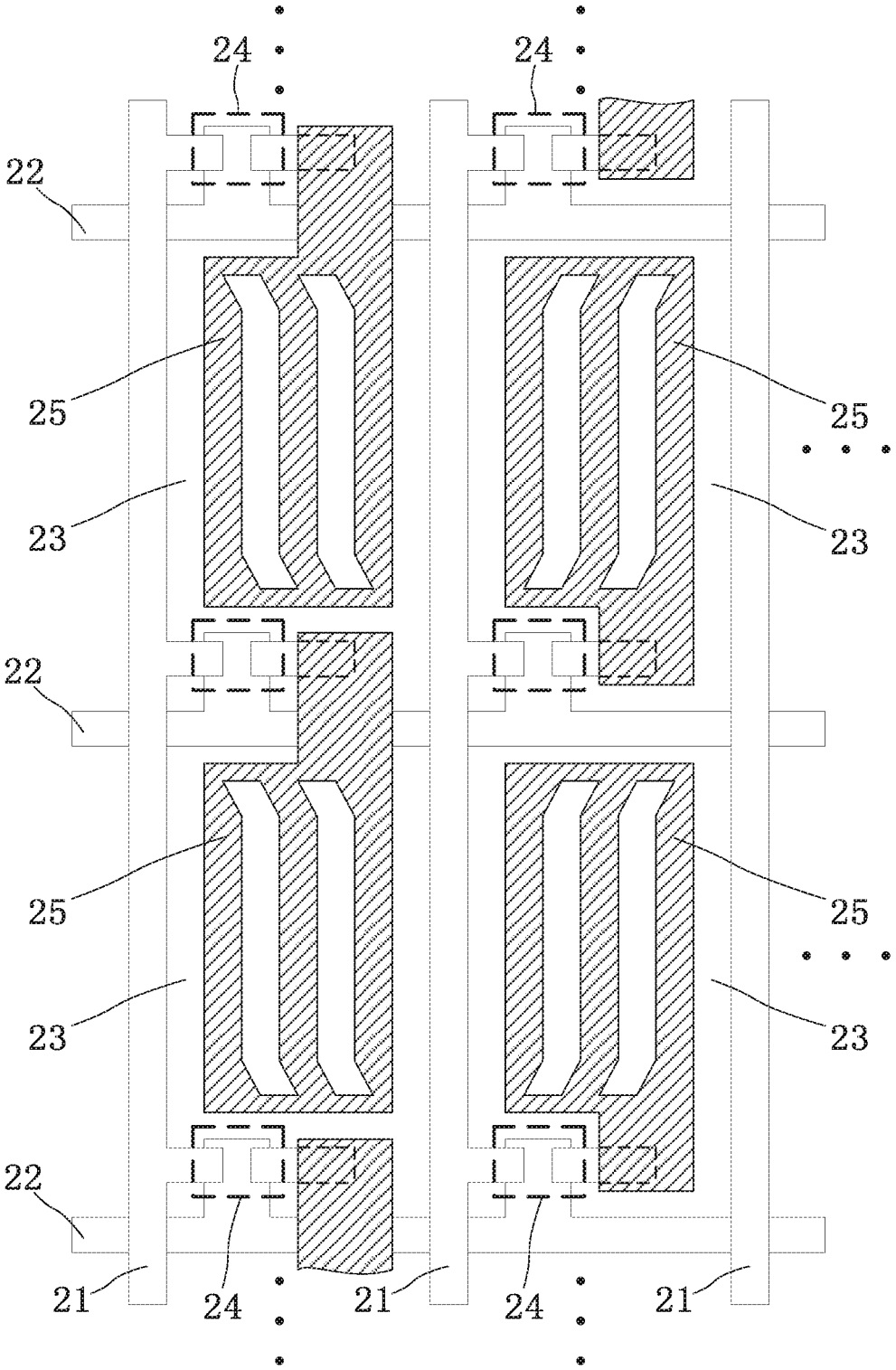
FIG. 2C is a schematic diagram of the structure of a pixel structure, according to embodiments of the disclosure.
Figure 3A:
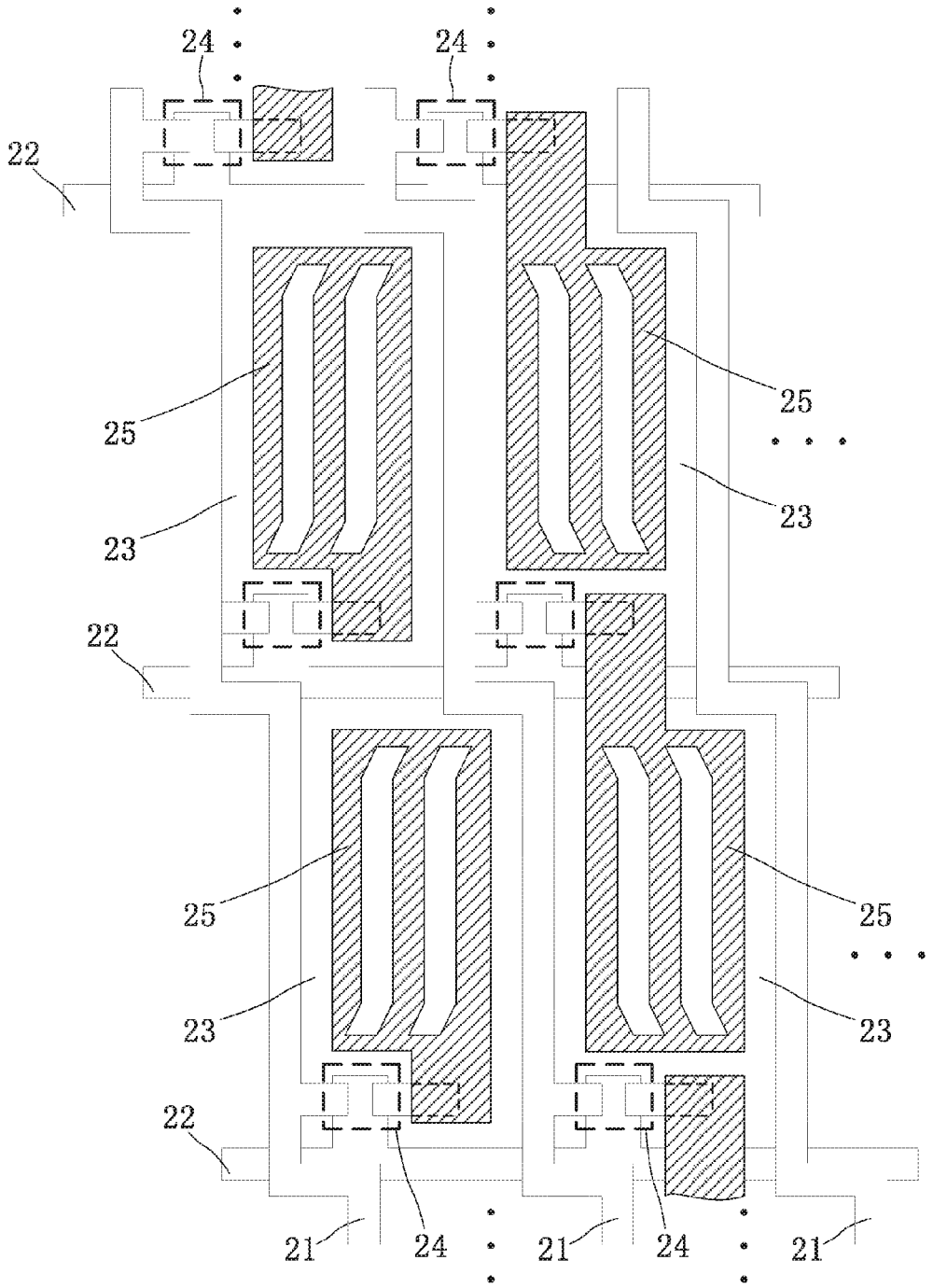
FIG. 3A is a schematic diagram of the structure of a pixel structure, according to embodiments of the disclosure.
Figure 3B:
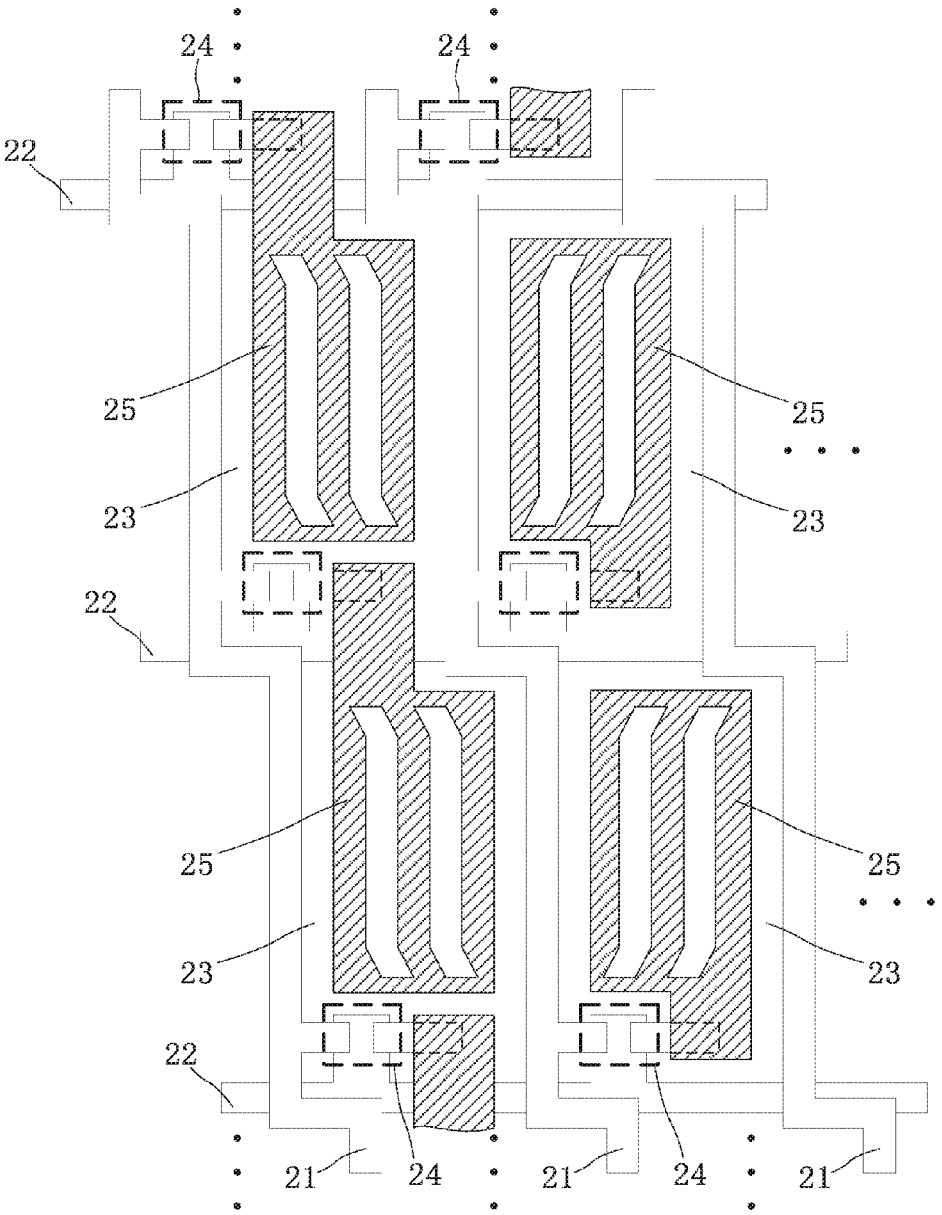
FIG. 3B is a schematic diagram of the structure of a pixel structure, according to embodiments of the disclosure.

In FIGS. 2A and 2C, the pixel units 23 are arranged as a matrix. In addition, the pixel units 23 may alternatively be arranged in a staggered way as shown in FIGS. 3A and 3B. In FIG. 3A, in each of odd columns of pixel units 23, a pixel electrode 25 of each pixel unit 23 is electrically connected with a thin film transistor 24 of the pixel unit 23; and in each of even columns of pixel units 23, a pixel electrode 25 of each pixel unit 23 in a row is electrically connected with a thin film transistor 24 of a pixel unit 23 in an adjacent preceding row. In FIG. 3B, in each of even columns of pixel units 23, a pixel electrode 25 of each pixel unit 23 is electrically connected with a thin film transistor 24 of the pixel unit 23; and in each of odd columns of pixel units 23, a pixel electrode 25 of each pixel unit 23 in a row is electrically connected with a thin film transistor 24 of a pixel unit 23 in an adjacent preceding row. The detail description of FIGS. 3A and 3B can refer to the description of FIGS. 2A and 2C, and will not be repeated again herein.

Further, referring to FIGS. 2A, 2C, 3A, and 3B, in the other one of the two adjacent columns of pixel units, the pixel electrode of each pixel unit in a row, which is electrically connected with the thin film transistor of a pixel unit in an adjacent row, partly overlaps the scan line electrically connected with the thin film transistor.

Figure 4A:
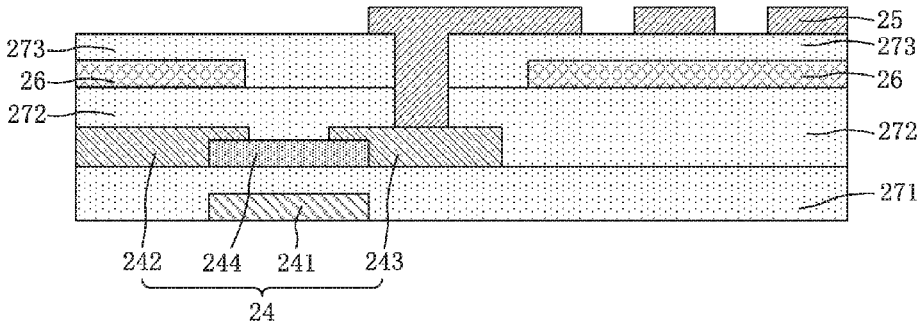
FIG. 4A is a schematic diagram of the structure of a pixel structure, according to embodiments of the disclosure.

Based on the pixel structure described above, a pixel structure in embodiments of the disclosure includes a common electrode 26 as shown in FIG. 4A. The common electrode 26 is located between the pixel electrode 25 and a film layer where the source electrode 242 and the drain electrode 243 of the thin film transistor 24 electrically connected with the pixel electrode 25 are located, and the common electrode 26 is electrically insulated from the pixel electrode 25 and the film layer by a second insulating layer 272. Additionally as shown in FIG. 4A, the gate electrode 241 is covered by a first insulating layer 271; an active layer 244 is located on the first insulating layer 271; the source electrode 242 and drain electrode 243 are arranged on two lateral sides of the active layer 244 and are both electrically connected to the active layer 244; the source electrode 242, the drain electrode 243, and the active layer 244 are insulated from the gate electrode 241 via the first insulating layer 271, the drain electrode 243 is electrically connected to the pixel electrode 25, and the common electrode 26 is insulated from the pixel electrode 25 via a third insulating layer 273.

Because in the other one of the two adjacent columns of pixel units, the pixel electrode 25 of each pixel unit 23 in a row, which is electrically connected with the thin film transistor 24 of a pixel unit 23 in an adjacent preceding row, partly overlaps the scan line 22 electrically connected with the thin film transistor 24, an affection on the electric signal might be generated at the overlapped area during working. Therefore, the common electrode 26 arranged between the source electrode 242 as well as the drain electrode 243 of the thin film transistor 24 and the pixel electrode 25 can protect the electric signal at the overlapped area between the pixel electrode 25 and the scan line 22.

In embodiments of the pixel structure described above, the pixel electrode 25 has a structure including slits, while the common electrode employs a whole planar structure. However, in other embodiments of the pixel structure, the common electrode may also employ a structure including slits, while the pixel electrode employs the whole planar structure within the pixel unit. In this case, referring to FIG. 4*b*, the common electrode 26 may be arranged on the pixel electrode 25 and insulated from the pixel electrode 25 via the third insulating layer 273.

Figure 4B:
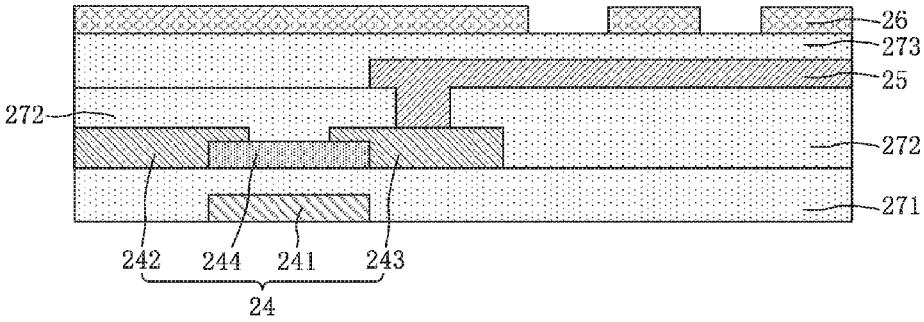
FIG. 4B is a schematic diagram of the structure of a pixel structure, according to embodiments of the disclosure.

It should be noted that, an example of the arrangement of the gate electrode 241 as shown in FIGS. 4A and 4B is exemplary, where the gate electrode 241 of the thin film transistor 24 is arranged below the source electrode 242 and drain electrode 243. However, in other examples, the gate electrode 241 may alternatively be arranged above the source electrode 242 and drain electrode 243, the arrangement manner of which is not limited herein.

Figure 5:
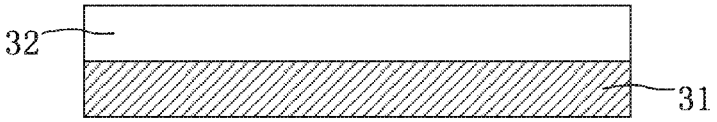
FIG. 5 is a schematic diagram of the structure of an array substrate, according to embodiments of the disclosure.

Embodiments of the disclosure provide an array substrate. FIG. 5 is a schematic diagram of the structure of the array substrate, according to embodiments of the disclosure. Referring to FIG. 5, the array substrate includes a glass substrate 31 and a pixel structure 32 which may be the pixel structure, according to the above embodiments.

Figure 6:
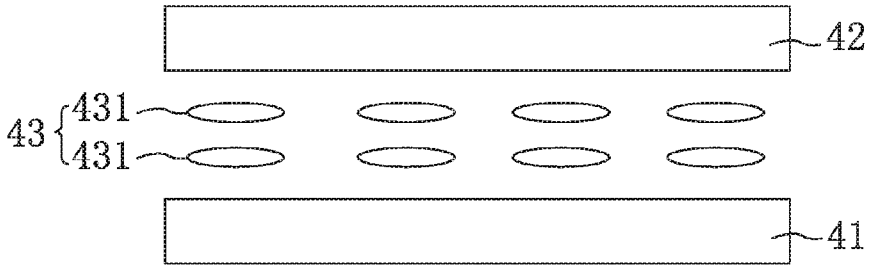
FIG. 6 is a schematic diagram of the structure of a display panel, according to embodiments of the disclosure.

Embodiments of the disclosure provide a display panel. FIG. 6 is a schematic diagram of the structure of a display panel, according to embodiments of the disclosure. Referring to FIG. 6, the display panel includes an array substrate 41, a color filter substrate 42 disposed opposite to the array substrate 41, and a liquid crystal layer 43 located between the array substrate 41 and the color filter substrate 42. The liquid crystal layer 43 is formed of liquid crystal molecules 431. The array substrate 41 may be the array substrate, according to the above embodiments.

It is noted that the above display panel may have or not have a touch sensing function, depending on specific requirements. The touch sensing function may be an electromagnetic touch sensing function, a capacitive touch sensing function or an electromagnetism and capacitance integrated touch sensing function.

Figure 7:
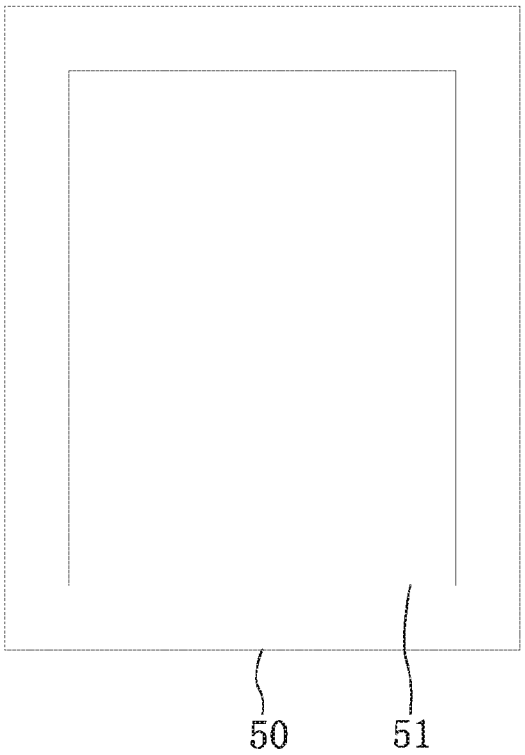
FIG. 7 is a schematic diagram of the structure of a display device, according to embodiments of the disclosure.

Embodiments of the disclosure provide a display device 50. FIG. 7 is a schematic diagram of the structure of a display device 50. Referring to FIG. 7, the display device 50 includes a display panel 51, and further includes a drive circuit and other devices for supporting a normal operation of the display device 50. The display panel 51 is the display panel according to the above embodiments. The display device 50 may be one of a cellphone, a desktop computer, a laptop computer, a tablet computer and an electronic paper.

Figure 8:
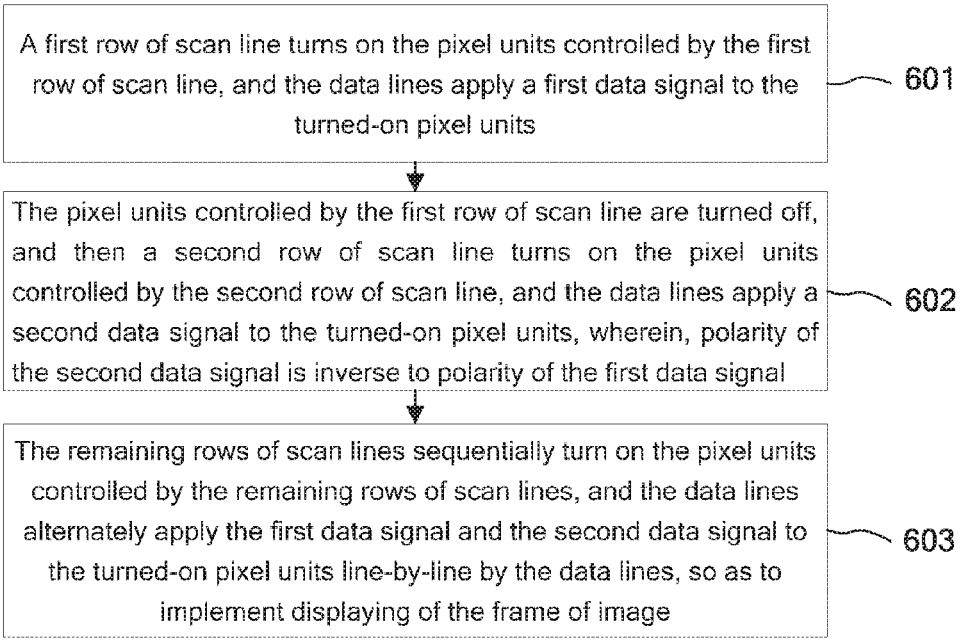
FIG. 8 is a schematic flowchart of a driving method of a display device, according to embodiments of the disclosure.

Some embodiments provide a driving method of the display device, which is implemented by the display device according to the above embodiments. FIG. 8 is schematic flowchart of the driving method of a display device according to embodiments of the disclosure. Referring to FIG. 8, the driving method of the display device includes following Steps 601 to 603 in displaying a frame of image.

In Step 601, a first row of scan line turns on the pixel units controlled by the first row of scan line, and the data lines apply a first data signal to the turned-on pixel units.

In Step 602, the pixel units controlled by the first row of scan line are turned off, and then a second row of scan line turns on the pixel units controlled by the second row of scan line, and the data lines apply a second data signal to the turned-on pixel units, wherein, polarity of the second data signal is inverse to polarity of the first data signal.

It should be noted that the polarity of the data signal is determined by the voltage difference between the voltage of the data signal and the common voltage. If the voltage difference is greater than "0", the polarity of the data signal is positive and usually indicated by "+"; and if the voltage difference is less than "0", the polarity of the data signal is negative and usually indicated by "−". Therefore, the fact that the polarity of a second data signal is inverse to the polarity of a first data signal specifically means that: when the polarity of the first data signal is positive, the polarity of the second data signal is negative; or when the polarity of the first data signal is negative, the polarity of the second data signal is positive.

In Step 603, the remaining rows of scan lines sequentially turn on the pixel units controlled by the remaining rows of scan lines, and the data lines alternately apply the first data signal and the second data signal to the turned-on pixel units line-by-line by the data lines, so as to implement displaying of the frame of image.

The pixel unit involved in the above steps includes a pixel electrode and a thin film transistor. In one of two adjacent columns of pixel units, a pixel electrode of each pixel unit is electrically connected with a thin film transistor of the pixel unit; and in the other one of the two adjacent columns of pixel units, a pixel electrode of each pixel unit in a row is electrically connected with a thin film transistor of a pixel unit in an adjacent row.

Because the display device for implementing the driving method of embodiments of the disclosure employs the pixel structure of the above embodiments, the dot inversion can be implemented by the row inversion within one frame of image in the case that the display device is driven through Steps 601 to 603. The principle used in the display device to implement the dot inversion by the row inversion through the above driving method will be described in detail below.

The pixel structure shown in FIG. 2A, for example, is used to further explain the principle used to implement the dot inversion by the row inversion in the display device driven through Steps 601 to 603. Provided that the pixel unit includes 7 data lines and 7 scan lines, the driving method includes Steps 6011 to 6012 as below.

In Step 6011, the pixel units controlled by the first row of scan line are turned on by the first row of scan line, and a first data signal with a negative polarity "−" is applied to the turned-on pixel units by the respective data lines.

Figure 9A:
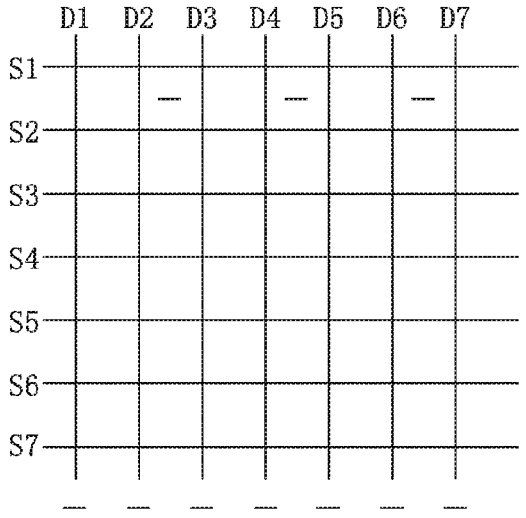

Referring to FIG. 9A, the first row of scan line 51 turns on the pixel units controlled by the first row of scan line 51, and the first data signal with a negative polarity "−" is applied to the turned-on pixel units by the respective data lines (D1-D7). As shown in FIG. 2A, the thin film transistor of the pixel unit is electrically connected with the scan line below the thin film transistor, and in each of the odd columns of pixel units, the pixel electrode of each pixel unit is electrically connected to the thin film transistor of the pixel unit, and in each of the even columns of pixel units, the pixel electrode of each pixel unit in a row is electrically connected to the thin film transistor of a pixel unit in an adjacent row, thus the even columns of pixel units controlled by the first row of scan line S1 are applied with the first data signal with a negative polarity "−" in FIG. 9A, and the odd columns of pixel units controlled by the first row of scan line S1 may be regarded as dummy pixel units and thus not shown in FIG. 9A.

In Step 6012, the pixel units turned on by the first row of the scan line are turned off, and then the pixel units controlled by a second row of scan line are turned on by the second row of scan line, and a second data signal with a positive polarity "+" is applied to the turned-on pixel units by the respective data lines.

Referring to FIG. 9B, the pixel units turned on by the first row of scan line S1 are turned off, and then the pixel units controlled by the second row of scan line are turned on by the second row of scan line, and the second data signal with a positive polarity "+" is applied to the turned-on pixel units by the respective data lines (D1-D7). As shown in FIG. 2A, the thin film transistor of the pixel unit is electrically connected with the scan line below the thin film transistor, and in each of the odd columns of pixel units, the pixel electrode of each pixel unit is electrically connected to the thin film transistor of the pixel unit, and in each of the even columns of pixel units, the pixel electrode of each pixel unit in a row is electrically connected to the thin film transistor of a pixel unit in an adjacent row, so that the even columns of pixel units controlled by the second row of scan line S2 are applied with the second data signal with a positive polarity "+" in FIG. 9B.

In Step 6013, the pixel units turned on by the second row of scan line are turned off, and likewise the pixel units controlled by the remaining rows of scan lines are sequentially turned on by the remaining rows of scan lines, and the first data signal with a negative polarity "−" and the second data signal with a positive polarity "+" are alternately applied to the turned-on pixel units line by line via the data lines, in order to implement displaying of a frame of image.

Referring to FIG. 9*c*, the pixel units turned on by the second row of scan line S2 are turned off, and then the pixel units controlled by the remaining rows of scan lines (S3 to S7) are sequentially turned on by the remaining rows of scan lines (S3 to S7), and the first data signal with a negative polarity "−" and the second data signal with a positive polarity "+" are alternately applied to the turned-on pixel units line by line via the data lines (D1 to D7), in order to implement displaying of a frame of image. Among the remaining pixel units, the polarity of the data signal applied to the pixel units controlled by an odd row of scan line is the same as the polarity of the data signal applied to the pixel units controlled by the first row of scan line S1, which can be referred to the description of Step 6011; and the polarity of the data signal applied to the pixel units controlled by the even row of scan line is the same as the polarity of the data signal applied to the pixel units controlled by the second row of scan line S2, which can be referred to the description of Step 6012. Additionally, FIG. 9C also shows the polarity of the data signal applied to each of the pixel units within one frame of image. As can be seen from FIG. 9C, in the display device employing the pixel structure of FIG. 2A, the dot inversion can be implemented by the row inversion via Steps 6011 to 6013.

In embodiments of the disclosure, an amplitude value of the polarity of the first data signal (i.e. an absolute value of a voltage difference between the voltage of the first data signal and the common voltage) is the same as the amplitude value of the polarity of the second data signal (i.e. an absolute value of a voltage difference between the voltage of the second data signal and the common voltage). For example, if the voltage of the first data signal is 10V and the common voltage is 6V, the voltage of the second data signal should be 2V, so that the voltage difference between the voltage of the first data signal and the common voltage is 4V, and the voltage difference between the voltage of the second data signal and the common voltage is −4V. Therefore, the polarity of the first data signal is inverse to the polarity of the second data signal, and the amplitude value of the polarity of the first data signal is the same as the amplitude value of the polarity of the second data signal.

In embodiments of the disclosure, the driving method of the display device is preferably carried out in a polarity inversion driving period including two frames of images. FIG. 10A shows the polarity distribution of the data signals when the display device implements the dot inversion by the row inversion in displaying the first frame of image. FIG. 10B shows the polarity distribution of the data signals when the display device implements the dot inversion by the row inversion in displaying the second frame of image. It can be seen from FIGS. 10A and 10B that the polarity of each dot (corresponding to one pixel unit) in displaying the first frame of image is inverse to the polarity of the same dot in displaying the second frame of image, that is, the polarity of the data signal in displaying the second frame of image is inverted as compared with that in displaying the first frame of image, meaning that the driving method of the display device is carried out in a polarity inversion driving period including two frames of images.

In addition to a polarity inversion driving period including two frames of images, the driving method of the display device can be carried out in a polarity inversion driving period including four frames of images or a larger even number of frames of images. For example, FIGS. 11A to 11D show that the driving method of the display device is carried out in a polarity inversion driving period including four frames of images. However, it can be seen from FIGS. 10A, 10B, and 11A to 11D that, if the driving method of the display device is carried out in a polarity inversion driving period including two frames of images, the polarity inversion frequency is increased, thereby reducing the possibility the permanent damage to the liquid crystal material caused by polarization of the liquid crystal material, so as to better protect the liquid crystal material.

With the pixel structure, array substrate, display panel, display device, and driving method of the display device provided in embodiments of the disclosure, in one of two adjacent columns of pixel units, a pixel electrode of each pixel unit is electrically connected with a thin film transistor of the pixel unit; and in the other one of the two adjacent columns of pixel units, a pixel electrode of each pixel unit in a row is electrically connected with a thin film transistor of a pixel unit in an adjacent row, so that for a certain row of pixel units, the pixel units controlled by two scan lines adjacent to the certain row of pixel units are alternately arranged, thereby implementing dot inversion by row inversion while ensuring a lower power consumption in polarity inversion. Additionally, to the above pixel structure, even if the source electrode and drain electrode of the thin film transistor are not precisely positioned relative to the gate electrode during manufacturing the thin film transistor, when the scanning signals applied by the scan lines are pulled down, the voltages of the pixel electrodes from the odd rows of pixel units are pulled down to the same degree as the voltages of the pixel electrodes from the even rows of pixel units, and accordingly, the common electrode compensating voltage required for the pixel electrode from the odd rows is equal to that required for the pixel electrode from the even rows, that is, the voltages of the pixel electrodes from both the odd rows and the even rows can be completely compensated by a common electrode, therefore, transverse striations and the flicker generated due to incomplete compensation by the common electrode for the voltages of the pixel electrodes from the odd rows and from the even rows can be avoided, and thus improving the display effect of the pixel structure.

It is noted that embodiments and the applied technology principles of the disclosure are described as above. It should be understood for those skilled in the art that the disclosure is not limited to particular embodiments described herein. Various apparent changes, readjustment and alternative can be made by those skilled in the art without departing the scope of protection of the disclosure. Therefore, although the disclosure is illustrated in detail through the above embodiments, the disclosure is not limited to the above embodiments, and can further include more of other equivalent embodiments without departing from the disclosure. The scope of the disclosure is subject to the appended claims.

Various modifications and additions can be made to the exemplary embodiments discussed without departing from the scope of the disclosure. For example, while the embodiments described above refer to particular features, the scope of this disclosure also includes embodiments having different combinations of features and embodiments that do not include all of the described features. Accordingly, the scope of the disclosure is intended to embrace all such alternatives, modifications, and variations as fall within the scope of the claims, together with all equivalents thereof.

We claim:

1. A pixel structure, comprising:

a plurality of data lines and a plurality of scan lines; and a plurality of pixel units formed by intersecting the plurality of data lines with the plurality of scan lines, wherein each of the plurality of pixel units corresponds to one of the plurality of data lines and one of the plurality of scan lines, and each of the plurality of pixel units comprises a pixel electrode and a thin film transistor therein, the thin film transistor comprises a gate electrode, a drain electrode, and a source electrode, the plurality of pixel units are arranged in columns, only one of the columns is arranged between every two adjacent ones of the plurality of data lines, and only one of the plurality of data lines is arranged between every two adjacent ones of the columns of pixel units, wherein the source electrodes of the thin film transistors of all pixel units in a same column are electrically connected to a same data line, wherein the plurality of pixel units comprises a first column of pixel units and a second column of pixel units adjacent to the first column of pixel units, the pixel electrode and the thin film transistor in a same pixel unit of the first column are electrically connected, and the second column of pixel units includes a first pixel unit and a second pixel unit adjacent the first pixel unit, the pixel electrode of the first pixel unit crosses over the scan line which is electrically connected with the thin film transistor of the second pixel unit, and the pixel electrode of the first pixel unit is electrically connected to the thin film transistor of the second pixel unit.

2. The pixel structure of claim 1, wherein the first column of pixel units is an odd-numbered column, and the second column of pixel units is an even-numbered column.

3. The pixel structure of claim 1, wherein the first column of pixel units is an even-numbered column, and the second column of pixel units is an odd-numbered column.

4. The pixel structure of claim 1, further comprising a common electrode located between the pixel electrode and a film layer where a source electrode and a drain electrode of the thin film transistor electrically connected with the pixel electrode are located, and the common electrode is insulated from the pixel electrode and the film layer.

5. The pixel structure of claim 1, wherein the plurality of pixel units are arranged in a staggered way or as a matrix.

6. A display device, comprising a pixel structure, with the pixel structure comprising:

a plurality of data lines and a plurality of scan lines; and a plurality of pixel units formed by intersecting the plurality of data lines with the plurality of scan lines, wherein each of the pixel units corresponds to one of the plurality of data lines and one of the plurality of scan lines; and each of the plurality of pixel units comprises a pixel electrode and a thin film transistor therein, the thin film transistor comprises a gate electrode, a drain electrode, and a source electrode, the plurality of pixel units are arranged in columns, only one of the columns is arranged between every two adjacent ones of the plurality of data lines, and only one of the plurality of data lines is arranged between every two adjacent ones of the columns of pixel units, wherein the source electrodes of the thin film transistors of all pixel units in a same column are electrically connected to a same data line, wherein the plurality of pixel units comprises a first column of pixel units and a second column of pixel units adjacent to the first column of pixel units, the pixel electrode and the thin film transistor in a same pixel unit of the first column are electrically connected, and the second column of pixel units includes a first pixel unit and a second pixel unit adjacent the first pixel unit, the pixel electrode of the first pixel unit crosses over the scan line that is electrically connected with the thin film transistor of the second pixel unit and the pixel electrode of the first pixel unit is electrically connected to the thin film transistor of the second pixel unit.

7. The pixel structure of claim 1, wherein every two adjacent rows of pixel units are separated by a corresponding one of the plurality of scan lines.

8. The pixel structure of claim 1, wherein the thin film transistor of the first pixel unit and the thin film transistor of the second pixel unit are electrically connected to a same one of the plurality of data lines.

9. The display device of claim 6, wherein every two adjacent rows of pixel units are separated by a corresponding one of the plurality of scan lines.

10. The display device of claim 6, wherein the thin film transistor of the first pixel unit and the thin film transistor of the second pixel unit are electrically connected to a same one of the plurality of data lines.

* * * * *